US007326308B2

(12) United States Patent
Mace et al.

(10) Patent No.: US 7,326,308 B2
(45) Date of Patent: Feb. 5, 2008

(54) METHOD FOR RECHARGING A BUNDLING MACHINE USING A PLASTIC FILM AND BUNDLING MACHINE CARRYING OUT SAID METHOD

(75) Inventors: Laurent Mace, Lisieux (FR); Francois Gosset, Lisieux (FR)

(73) Assignee: Cermex Quest Conditionnement, Lisieux (FR)

( * ) Notice: Subject to any disclaimer, the term of this patent is extended or adjusted under 35 U.S.C. 154(b) by 210 days.

(21) Appl. No.: 10/474,457

(22) PCT Filed: Apr. 2, 2002

(86) PCT No.: PCT/FR02/01124

§ 371 (c)(1),
(2), (4) Date: Dec. 12, 2003

(87) PCT Pub. No.: WO02/083533

PCT Pub. Date: Oct. 24, 2002

(65) Prior Publication Data

US 2004/0103977 A1 Jun. 3, 2004

(30) Foreign Application Priority Data

Apr. 10, 2001 (FR) ..... 01 04833

(51) Int. Cl.
*B32B 41/00* (2006.01)
*B65H 21/00* (2006.01)

(52) U.S. Cl. ..... 156/64; 156/157; 156/159; 156/304.1; 156/304.6; 242/555.4

(58) Field of Classification Search ..... 156/64, 156/157, 159, 304.1, 304.6; 242/551, 554, 242/554.1, 554.2, 554.6, 555.2, 555.3, 555.4
See application file for complete search history.

(56) References Cited

U.S. PATENT DOCUMENTS 3,983,774 A * 10/1976 Seragnoli ..... 83/289

(Continued)

FOREIGN PATENT DOCUMENTS

DE 22 23 907 A 12/1973

(Continued)

*Primary Examiner*—George Koch
(74) *Attorney, Agent, or Firm*—Sughrue Mion, Pllc.

(57) ABSTRACT

Methods for recharging a machine which is used to pack groups of products with the aid of a plastic film wherein the film of a distributor reel is unwound, the film of a full reel is subsequently engaged into an injection device in such a way that said reel becomes a distributor reel in turn, then the empty distributor reel is replaced with a new full reel. While a reel is being distributed, the full reel is placed in the machine and the free end of the film connected to the full reel is maintained in a waiting position; when it is detected that the end of the film of the distributor reel has reached a predetermined position, the advance of the film of said reel is halted and the free end of the film connected to the full reel is driven in such a way that it becomes a distributor reel; while the full reel is being distributed, the empty distributor reel is replaced by a new full reel and the free end of the beginning of the film connected to said new reel is maintained, whereupon the previously mentioned cycle is resumed with a new reel when the final extremity of the film of the full reel which is being distributed reaches a predetermined position in the machine.

9 Claims, 3 Drawing Sheets

U.S. PATENT DOCUMENTS 4,705,225 A * 11/1987 Miyazaki et al. ..... 242/523.1
4,772,350 A * 9/1988 Gamberini ..... 156/366
6,451,145 B1 * 9/2002 Forbes ..... 156/159

FOREIGN PATENT DOCUMENTS

EP 0 622 318 A 11/1994
WO WO 98 41463 A 9/1998

* cited by examiner

METHOD FOR RECHARGING A BUNDLING MACHINE USING A PLASTIC FILM AND BUNDLING MACHINE CARRYING OUT SAID METHOD

BACKGROUND OF THE INVENTION

This application is a 371 of PCT/FR02/01124, filed on Apr. 2, 2002.

The invention concerns improvements to the methods for reloading machines for packaging under plastic films, called bundling machines, through the use of such films. More particularly, it concerns a method for the quick loading of the film, and of machines that implement this method.

Packaging products under film is a popular technique, which allows a number of products such as bottles, flasks, boxes, pots, or any other type of objects to be grouped together. This technique makes it possible to facilitate the transport of the products to the final destination where the packaging is removed. Depending on the type of products packaged, either the film is the only element of the packaging, or it is associated with other elements such as boards, trays or other elements on which the products are arranged before being placed under film.

Machines intended for producing such packages are called bundling machines. They allow each group of products to be enclosed in a section of film. To that end, they include, on the one hand, a device for feeding the groups of products to be packaged, such as a conveyor, and when appropriate a device for feeding associated elements, and on the other hand a distributor spool of film, a device for directing a first end of the film toward each group of products to be packaged, devices for placing the film around the group of products in synchronism with the advance of the film, devices for cutting the film when a section of sufficient length is obtained and devices for closing the film around the group of products.

In certain machines, the film used is of the heat shrinking type, and the closure is accomplished by securing the film in a film heat-shrinking tunnel. In other machines, the closure is accomplished by heat welding or gluing.

The device for directing a first end of the film toward the group of products to be packaged, called film injection device, comprises for example drive rollers between which the film is placed, and downstream of these rollers, in the direction of advance of the film, a gripping device. The film, drawn between the rollers, is then gripped by the gripping device which directs it towards a conveyor or a table on which the group of products is placed, and which causes the film to undergo a movement allowing it to enclose the group of products. Furthermore, when a sufficient length of film to form a section allowing the group of products to be enclosed is unwound, the film is cut so that a section of the film is completely available to package the group of products, and the rest of the film can be used to package the subsequent groups of products by repeating the above-mentioned operations.

Generally, and most particularly in the applicant's machines, the cutting means are associated with the injection device. In fact, said injection device comprises a first set of two rollers, called upstream, that are in tangential contact with each other, one of said rollers being the driver and the other driven, and a second set of two other rollers, called downstream, identical to the first, also in tangential contact, with a drive roller and a driven roller, and the cutting means are arranged between the two sets. The film is arranged so that it passes between the two rollers of each set, and is drawn through as a result of the pressure exerted between the two rollers of a same set. The cutting means are activated at appropriate times, in synchronism with the cycle of the machine.

These machines require that the film distribution spool be replaced regularly, when all of the available length of film has been consumed. To that end, the machines include a storage device for a full standby spool. Said standby spool is placed on this device while another distributor spool is in the process of unwinding, and the change of distributor spool requires the packaging operations to be stopped in order to heat-fuse the beginning of the film from this spool to the end of the film from the spool that is finished.

In the applicant's machines, by way of example, for the groups of products of medium size that these machines package, the change of distributor spool takes place approximately every twenty minutes, and the time of the shut-down and heat-fusing that this change involves lasts about twenty seconds if they are properly and efficiently carried out. Therefore, approximately one minute of packaging time is lost every hour because of the spool changes.

The preceding is true for films free of decorations that do not require precise positioning with respect to each other prior to the fusing. However, there are decorated films that require that the designs be aligned with the designs of the other one prior to fusing, which prolongs the operations.

In fact, contrary to what one would believe, it is not the heat-fusing of the end of the film from the full distributor spool to the end of the film from the preceding spool that consumes the most time. On the contrary, this operation makes it possible to gain time compared to the operation consisting of paying out all of the preceding film before reloading the machine with a new distributor spool. In effect, between the zone of the machine where the distributor spool is placed and the injection device, there is a compensation mechanism with a set of compensator rollers mounted on an articulated device, called "jumping jack," which allows the tension and unwinding speed of the film to be adjusted in order to take into account the fact that the packaging operations are not carried out at a constant speed of unwinding of the film. The rollers of this mechanism cause the film to follow a trajectory that is relatively complex, and in any case non-linear, between the distributor spool and the injection device, so that if it was necessary to allow all of the film to pay out, then, at the time of reloading it would be necessary to position the new film correctly with respect to the set of compensator rollers, then engage it in the injection device by holding it correctly to prevent it from becoming crumpled or laterally offset from said injection device. These operations would take even more time to accomplish.

Thus, by heat-fusing the end of the preceding film to the beginning of the new one, the new one is immediately positioned correctly in the compensation mechanism and becomes engaged in the injection device by being drawn by the remainder of the film from the preceding roll.

However, in order for the operation to be efficiently carried out, it is still necessary for the operator to be present at the appropriate time, that is, when the end of the film is approaching.

To that end, the known machines include means of detecting the approach of the end of the film on the distributor spool that is unwinding. Said means determine the length of film remaining on this spool and are activated when it is less than a predetermined value. Indeed, because it is difficult to detect a length of film rolled onto a spool, the means often detect the remaining thickness of film on the distributor spool, which is a function of the remaining length.

These detection means can be coupled with means for warning the operator who, as soon as he is warned, takes over manual control of the machine and oversees the unwinding of the end of the distributor spool, then stops the machine at the appropriate time and performs the heat-fusing operation, restarts the machine, removes the empty spool and mounts a full standby spool. With this method of operation, if the operator is absent when the warning is given, there is a risk that the distributor spool could unwind completely and the film totally released, involving completely reloading the machine with the new film, that is, by positioning it correctly with respect to the set of compensator rollers, then by engaging it again in the injection device.

Alternatively, the detection means can be coupled with means for stopping the film. This assumes that the operator takes over manual control of the machine after the film is stopped, then oversees the unwinding of the end from the distributor spool, and stops the machine at the appropriate time to perform the heat-fusing operation, restarts the machine, removes the empty spool and mounts a full standby spool. With this mode of operation, if the operator is absent at the time of stopping, there is a risk of loss of additional time.

A purpose of the invention is to remedy these disadvantages.

SUMMARY OF THE INVENTION

According to the invention, a method for reloading a machine that packages groups of products with a plastic film intended for said packaging, said machine comprising on the one hand means of injection and cutting the film, fed with film from a distributor spool located upstream in the direction of unwinding of the film of the injection and cutting means, and on the other hand means for storing a full spool, also upstream from the injection and cutting means, the method being of the type according to which, after detection of the approach of the end of the film on the distributor spool, various steps are implemented that make it possible to finish unwinding and emptying said spool, and engaging the film from the full spool into the injection means, so that said injection means becomes the distributor in turn, then the spool that has been emptied is replaced by a new full spool, characterized in that it consists of:

while a spool is in the process of distribution, placing a full spool in the machine and keeping the free end of the start of the film on this full spool ready at the entrance of the injection and cutting means;

after having detected that the last part of the end of the film on the spool in process of distribution has reached a predetermined position in the machine, stopping the advance of the film of this spool in the injection and cutting means, and causing the free end of the film connected to the full spool to be drawn into said means, so that said full spool becomes the distributor;

while said full spool is in process of distribution, replacing the one that was emptied with a new full spool, and maintaining at the entrance of the injection and cutting means the free end of the beginning of the film connected to said new spool, and starting this cycle over again with the new spool, when in turn the end of the film of the spool in process of distribution reaches a predetermined position in the machine.

Thus, when the time comes to replace a spool, it is no longer necessary to heat-fuse the end of the film from the spool that has just been emptied to the beginning of the film on the full spool, and there is therefore no dead time during the replacement. Moreover, this mode of operation makes it possible to automate the replacement operation, thus reducing the demands on the operator who no longer has to act immediately after the detection of approach of the end of the film of a spool. The operator then has all the time he needs to replace the spool that has just been emptied with a full one.

In one implementation, all of the film from the spool in process of distribution is allowed to pay out, and the predetermined position, which is detected, of the final end of this spool in the machine is the one where said film end leaves the injection and cutting means.

Thus, the free end of the beginning of the film on the full spool is led into the injection and cutting means when the film from the other spool has been completely consumed.

This implementation eliminates the fusing of one film to the other.

However, for each spool change this involves repositioning the film of the full spool at the entrance of the injection and cutting means and into the compensation mechanism. This maneuver is quite conceivable within the time taken by a spool to completely unwind. However, it is tedious and requires a great deal of the operator's time.

It is for this reason that, in a preferred implementation, when a spool is finished, all of the film is not allowed to pay out but a portion is preserved on the machine, and said portion is heat-fused to the beginning of a full spool without stopping production. The end of the remaining portion of one film is therefore connected to the beginning of the film of a full spool, and it is thus the remaining part that draws in the film from the full spool when the latter is placed in service.

To that end, according to another characteristic, the method consists of monitoring the passage of the last part of the end of the film from the spool in process of distribution, into the machine, into a predetermined position situated between the spool and the injection and cutting means; and when the passage into this position is achieved, the advance of the film from this spool into the injection and cutting means is stopped, in order for a portion of film to remain between said film end and the injection and cutting means, and the free end of the film connected to the full spool is drawn into said means so that it becomes the distributing spool;

removing the empty spool and putting a new full spool in place;

fusing the beginning of the film from the full spool to the end of the remaining part of the film from the spool that was removed.

Thus, apart from the removal of an empty spool and the installation of a full one, this implementation only requires fusing while production continues, while a spool is being unwound. This allows time for the operator to perform this operation with precision, even in the case of films with decorative designs; moreover, the fusing has proper cooling time and there is no longer any burdensome and complex operation of replacing the film, because the new one is drawn by a remaining part on standby.

In one implementation, the detection of the predetermined position of the end of the film from the spool in process of distribution is performed twice: a first time, when an approximate evaluation is made of the remaining length of film wound on this spool during the distribution, then, when a predetermined value is reached, the advance of the film from this spool into the injection and cutting means is stopped, the full spool is placed in service by causing the free end of the film from this full spool to be drawn into said injection and cutting means so that the latter spool becomes the distributor and the other one is stopped; and a second time where the remaining length of film wound on the stopped spool is precisely determined, after which:

a) if the length of film remaining on this stopped spool is sufficient to continue packaging groups of products, the advance of the film from the other distributing spool into the injection and cutting means is stopped, the free end of the film connected to the spool on standby is drawn into said means so that said standby spool becomes the distributing spool again, and the passage is monitored of the upstream end of the film from the spool in the machine into the predetermined position located between the spool and the injection and cutting means; and when the passage into this position is reached, the advance of the film from this spool into the injection and cutting means is stopped, the free end of the film connected to the other spool is drawn into said means so that it becomes the distributing spool again;

the empty spool is removed and a full spool is installed;

the beginning of the film from the full spool is fused to the end of the remaining part of the film from the removed spool, and [the operator] waits until the remaining length of film wound on the second spool requires another change of spool;

b) if the remaining length of film on this stopped spool is not enough to continue packaging groups of products, packaging is continued with the other spool until it is determined that the remaining length of film wound thereon requires another change of spool, and during this time, the end of the film from the first spool is drawn into the machine, in said predetermined position located between the spool and the injection and cutting means, and the empty spool is removed and a full spool is put in place;

the beginning of the film from the full spool is fused to the end of the remaining film from the spool that has just been removed; and the preceding operations are resumed by changing over from one spool to another.

This mode of operation makes it possible to take into account the difficulty in measuring the remaining length of film on a spool when it is unwinding, while avoiding losing film. It is easier to make an approximate determination of the remaining length of film, for example, as indicated above, by evaluating the remaining thickness of film wound onto the spool. The evaluation can be only approximate, among other reasons because of the vibrations of the machine and because there are certain tolerances for the thickness of the film itself when it is manufactured.

The approximate evaluation of the length of film remaining wound on the spool in process of distribution and the placement in service of the full spool can be performed by the operator himself; however, to allow the operator to perform other activities and to prevent the spool from becoming completely unwound if the operator is absent, an automatic evaluation and automatic change-over are preferred.

The precise determination of the remaining length is easier when a spool is stopped. Here also, this determination can be done by the operator, or it can be done automatically; this also applies to putting this spool back in service in the event there is enough length still on it.

Finally, the monitoring of the passage of the upstream end of the film from the spool in process of distribution in the machine, in said predetermined position, can be done by the operator or it can be done automatically.

According to another characteristic, the machine having a compensation mechanism between each spool and the injection and cutting means, the predetermined position located between the spool and the injection and cutting means is monitored so that the advance from one spool in process of distribution is stopped when the end of the film carried by this spool is between the spool and the corresponding compensation mechanism. In this way, after the fusing is performed, the remaining part of the film from a spool is used to engage the film from a new spool into the compensation mechanism.

Thus, except for those rare cases in which a film comes off of the compensation mechanism, which can occur following maintenance on the machine or an accidental tearing of a film, the film change operations take very little of the operator's time, and he can therefore concentrate on other tasks required by the machine.

A device for implementing the method is characterized in that it comprises two arrangements for alternatively distributing the film from one spool and from the other to the injection and cutting means, which arrangements include means, called drive and hold, arranged to hold the free end of the film from the standby spool at the entrance of the injection and cutting means, and to allow the film from the distributing spool to be drawn into the injection and cutting means.

According to another characteristic, the arrangements are identical.

In one implementation, the injection and cutting means are comprised of a single device having rollers for driving the film at its entrance, the drive and holding means are comprised of two different devices arranged upstream from the entrance of the single injection and cutting device, and the machine is constructed so that, after having stopped the advance of the film from one spool in process of distribution in the injection and cutting means, the movement of the film in said means is reversed so as to release the free starting end, it is held with the corresponding drive and holding device, and the free end is then drawn to the beginning of the standby film toward the injection and cutting means with the other corresponding drive and holding device.

In one variation of implementation, the injection and cutting means are comprised of two different devices, each of which receives the film from a spool, and each has at its entrance rollers for driving the film, and the drive and holding means are comprised of drive rollers located at the entrance of the injection and cutting devices, and the machine is constructed so that the advance of the film from one spool in process of distribution into an injection and cutting device is stopped by stopping the rotation of these entry drive rollers, and the drawing of the starting free end of the standby film, in the other injection and cutting device, is caused by placing these entry drive rollers in rotation.

BRIEF DESCRIPTION OF THE DRAWINGS

Other characteristics and advantages of the invention will become apparent from the following description, with reference to the attached drawings in which.

DETAILED DESCRIPTION OF EXEMPLARY, NON-LIMITING EMBODIMENTS

The invention can be implemented on any known bundling machine. Thus, FIG. 1 diagrammatically illustrates the application of the invention to a machine for packaging groups of products 1, 2, 3, 4 using film 5 of plastic material, which is made integral with a group of products around which it was wound through the use of any appropriate device 6, such as a heating tunnel when the plastic material used is heat-shrinkable, or a heat-fusing device or gluing device, as mentioned in the introduction.

Figure 1:
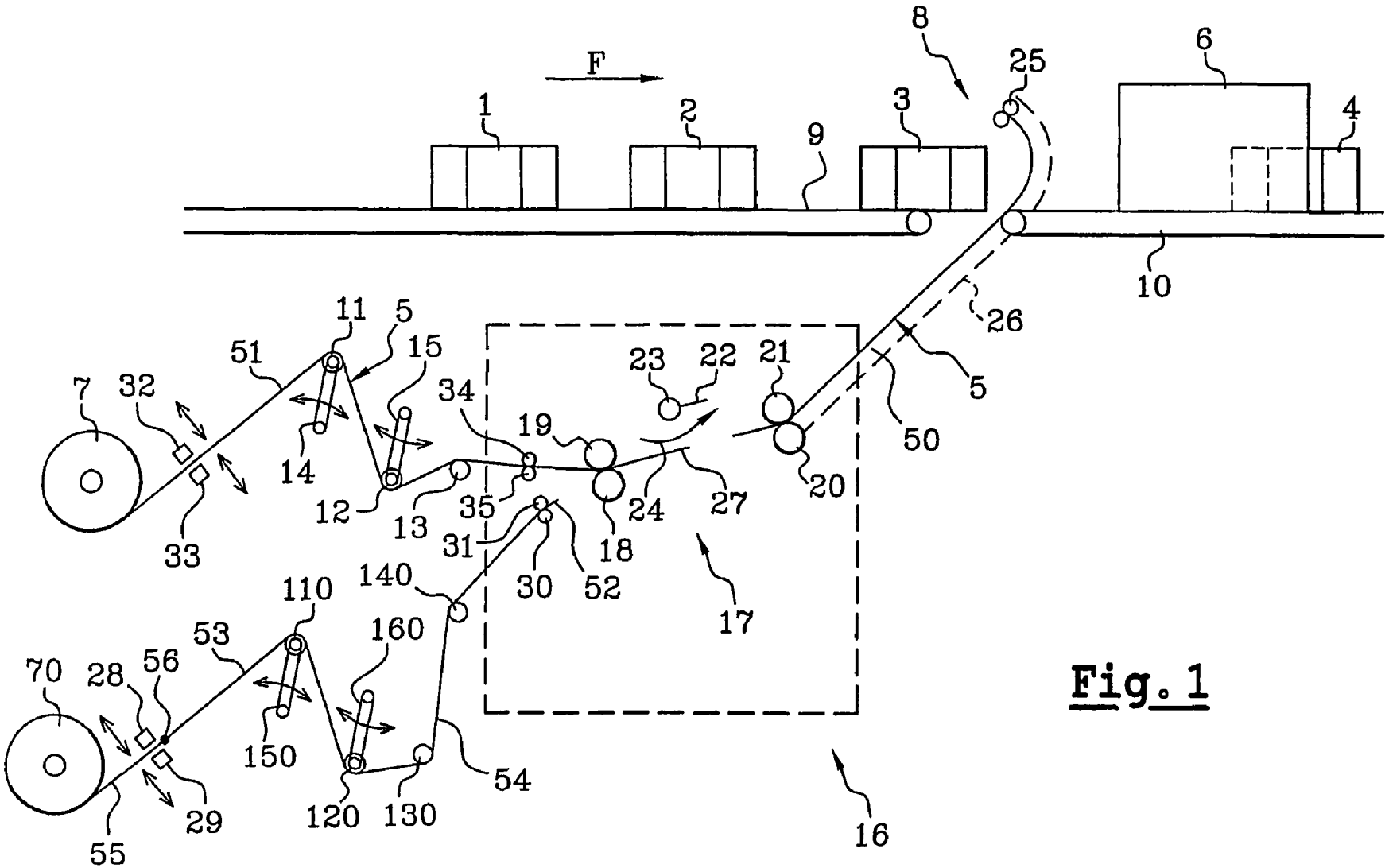
FIG. 1 is a diagrammatic side view of a machine for the implementation of the method.

The device of FIG. 1 is arranged to avoid having to reload the compensator rollers for each spool change.

The film 5 is distributed from a distributor spool 7 and is directed to the packaging zone 8 in which, in a known way, the groups of products are transported, for example by means of a conveyor belt 9; they leave in the same way by means of another conveyor 10 that takes them to the closing device 6.

In its path from the distributor spool 7 to the packaging zone 8, the film encounters guide devices such as the rollers 11, 12, 13 which, for some of them 11, 12, are compensator rollers which, in addition to their guide function, contribute to the adjustment of the tension of the film as it is paid out of distributor spool 7. To that end, the rollers 11, 12 are attached to movable mechanisms 14, 15 called jumping jacks.

Downstream from the guide devices 11, 12, the film 5 passes into a device 16 which, according to the invention, can be made in several variations, which will subsequently be described in detail. Among other things, the device 16 has means 17 for the injection and cutting of the film.

In FIG. 1, the injection and cutting means are comprised of a single device, the structure of which, as is known, includes a first set, called upstream, of two rollers 18, 19, called injection, in tangential contact with each other, one of which, 18 for example, is the driver and the other 19 is driven, and a second set, called downstream, identical to the first, of two other rollers 20, 21, called pressure, also in tangential contact, with one drive roller 20 and one driven roller 21. The film is arranged between the two rollers of each set, and is driven by the pressure exerted between the two rollers of the same set.

In the area of the machine delimited between these two sets, means 17 for the injection and cutting of the film include a device with a unit 22 for cutting the film The unit 22 for cutting the film, in order to make successive the sections thereof, is comprised in a known way by a sharp blade mounted on a bar 23 that can turn around its longitudinal axis as illustrated by the arrow 24. The unit 22, here called the blade, and the bar comprise the cutting device as such, which device is controlled by the machine's control mechanism as a function of the desired length of sections of film required to enclose the groups of products. To cut the film, the bar 23 is made to rotate so that the cutting edge of the blade passes through the thickness of the film while it is moving.

To that end, the bar 23 is connected to means to cause its rotation at the appropriate times as the film advances in the machine. Thus, in one implementation, the means to cause the rotation are comprised of a motor, not shown, which can be sequentially controlled. In one variation, the rotational movement is caused by a cam mechanism connected, for example, to the drive mechanism of the drive rollers 18, 20.

The means for causing the rotation of the bar can be connected thereto directly or through a transfer mechanism.

Thus, in a known way, at the moment the film is cut, there are two portions of film: a first portion 50 forming a section to package a group 3 of products, and a second portion 51 integral with the distributor spool 7. The first portion 50 is sent toward a group 3 of products by means of a known movable guide device 25, and comprised for example of a set of bars that come to grip the film at the outlet of the downstream set of pressure rollers 20, 21, and causing it to follow an appropriate path, symbolized by the broken line 26, to enclose the group 3 of products, while the second portion 51 continues to be drawn by the set of two injection rollers 18, 19 upstream from the means 17.

In a known way, the two sets are arranged so that, either they are associated with means not represented such that, when the film has been cut, the end 27 of the second portion 51 of film, which is then located between the two sets, is directed between the two rollers 20, 21 of the downstream set and is picked up by said rollers, before being gripped in turn by the guide device 25 which draws it toward the next group of products, again following the appropriate path symbolized by the broken line 26.

According to the invention, a full spool 70 is placed in the machine, while the film 5 from the distributor spool 7 is in the process of unwinding, and the free end 52 of the film 53 connected to this full spool is held on standby at the entry of the injection and cutting means.

As illustrated, the machine has between this full spool 70 and the entry of the injection means, a second set of guide devices with the rollers 110, 120, 130, 140, some of which 110, 120, are compensator rollers. These are then attached to movable mechanisms 150, 160 such as jumping jacks.

According to the invention, the film 53 connected to the full spool is in two parts: a first part 54, which is the remaining portion of film from a spool previously unwound in the place of the spool 70, and a second 55 which is the beginning of the film originally placed on the full spool.

The two parts 54, 55 are connected the each other by a weld 56 made by heat.

The weld 56 is therefore made at the end of the film from the spool that was previously in the place of the spool 70 and at the beginning of the film from the spool 70, when said spool is installed.

To accomplish the weld, means are provided, such as welding bars 28, 29, between which the film travels.

The first part 54 is routed along the second set of guide devices, with the rollers 110, 120, 130, 140.

Consequently, the welding bars are placed between the spool 70 and the second set of guide devices, with its rollers 110, 120, 130, 140.

Figure 2:
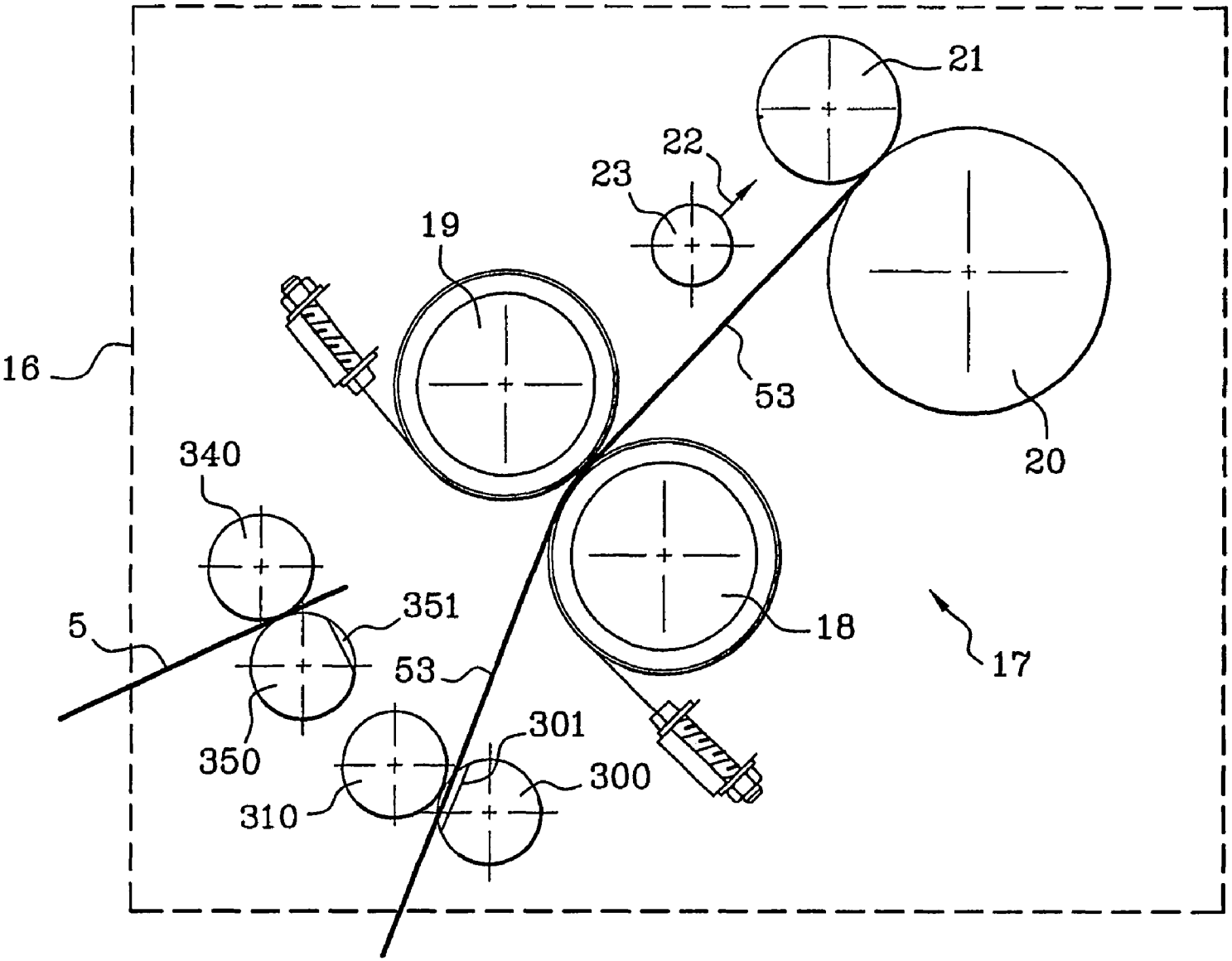
FIGS. 2 to 4 are diagrammatic side views of variations of embodiment of the part of the machine that makes it possible to use the film from one spool or the other.

The free end 52 of the film 53 connected to this full spool 70 is held at the entrance of the injection means 17 by drive and holding means, comprised in the example by the holding rollers 30, 31 a preferred form of embodiment of which is shown in FIG. 2.

The holding rollers 30, 31 are connected to motorized units, not visible, which are designed to be turned on to drive the film 53 toward the injection rollers 18, 19 to allow it to be picked up by said rollers, and to be stopped in order to hold the film immobilized.

Indeed, with the configuration of FIG. 1 where it is the film from the spool 7 that is being driven by the injection rollers 18, 19, the holding rollers 30, 31 are in the stopped position.

In one implementation, the motorized units are designed to be turned on when the film 53 should be driven by the injection rollers, so that the film is driven by the holding rollers at the same speed as by the injection rollers.

In one variation the holding rollers are self-disengaging with respect to the motorized units, and are disengaged when the film 53 is driven by the injection rollers, so that in this configuration the film travels freely between the holding rollers.

The film 5 being unwound from the distributor spool 7 also passes between the welding bars 32, 33, in order to allow the spool change when the spool becomes empty, and between the holding rollers 34, 35 upstream from the injection rollers 18, 19.

In a way identical to the rollers 30, 31, the holding rollers 34, 35 are connected to motorized units, not visible, which are designed to start up to drive the film 5 toward the injection rollers 18, 19 in order to allow it be to be picked up by said injection rollers, and to be stopped to hold the film immobilized.

With the configuration of FIG. 1 where it is the film from the spool 7 that is driven by the injection rollers 18, 19, the holding rollers 34, 35 are controlled or placed in a position such that the film from the spool 7 travels freely.

This form of embodiment, therefore, makes it possible to change film without clearing either of the guide devices with the compensator rollers.

Thus for example, considering the distributor spool 7, in process of distribution, it is only necessary to detect the position of the end of film 5 on this spool before said end reaches the corresponding guide device 11, 12, 13, and when it reaches a predetermined position, manually or automatically to stop this spool, reverse the direction of rotation of the injection rollers, pick up the film 5 with the corresponding holding rollers 34, 35, and start the other film 53 toward the injection rollers by means of the corresponding holding rollers 30, 31.

Of course, as already explained, if after the film 5 is stopped, it is detected visually or automatically that enough usable film remains, it is still possible to restart this film, manually or automatically, until the film effectively reaches the end of the spool, and ensure that it does not leave the respective guide device.

Next, the other spool is started and a new spool is put in place before proceeding with the welding.

In FIG. 2, a preferred form of embodiment is illustrated for the device 16, including, among others, the means 17 for injection and cutting of the film.

The device 16 is represented in a position in which the film 53 is being driven and the film 5 is immobilized.

As already explained, the injection and cutting means include the upstream set of two injection rollers 18, 19, and the downstream set of two other pressure rollers 20, 21, as well as between these two sets, the device with a unit 22 for cutting the film, comprised of a sharp blade carried by the bar 23 that can turn around its longitudinal axis.

Two sets of holding rollers are arranged upstream from the injection rollers 18, 19. The film 53 is positioned so as to pass between the rollers 300, 310 of the first set, and the film 5 is positioned so as to pass between the rollers 340, 350 of the second set.

One of the rollers 300, 350 of each of these sets is not completely cylindrical, but is provided with a flat surface 301, 351 parallel to the axis of rotation of its respective roller 300, 350. The drivers, not shown, are designed to place the flat surface facing the other roller of the device when the film should be driven by the injection rollers, so that the film runs freely in the gap that then appears between the two rollers.

Thus, in considering FIG. 2 where the film 53 is driven, the rollers 300, 310 are stopped, with the flat surface 301 of the roller 300 facing the roller 310; the rollers 340, 350 are stopped with their cylindrical part in tangential contact to block the film 5.

When the film is changed, the direction of rotation of the injection rollers 18, 19 is reversed to release the beginning, and the holding rollers 300, 310 are simultaneously placed in rotation in order to clamp the film 53 and prevent it from being released from said rollers, after which the holding rollers are stopped. Next, the rollers 340, 350 are placed in rotation to drive the free end of the film 5 into the injection rollers.

However, to prevent film from being released from the holding rollers when they are placed in rotation to drive the film toward the injection rollers, it is best that the gap not appear during this phase. To that end, the holding rollers of each device are arranged so that the length of the portion of film that could be taken between the injection rollers and the holding rollers is less than the perimeter of the cylindrical portion of each roller provided with a flat surface.

Figure 3:
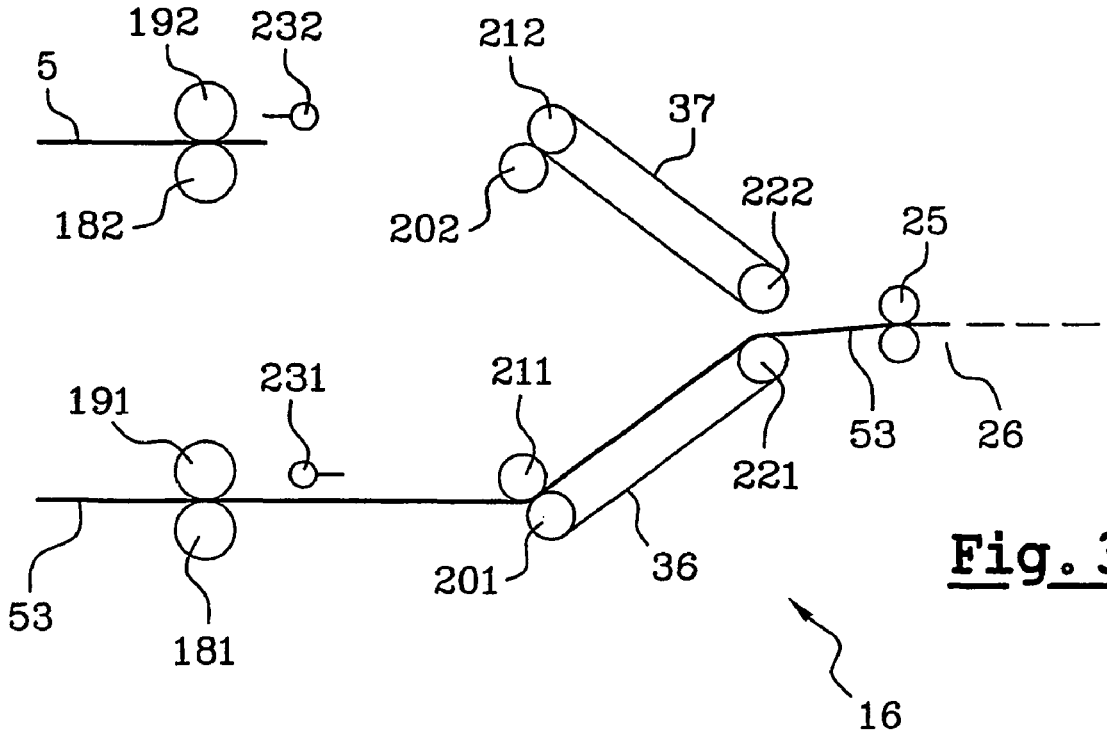
Figure 4:
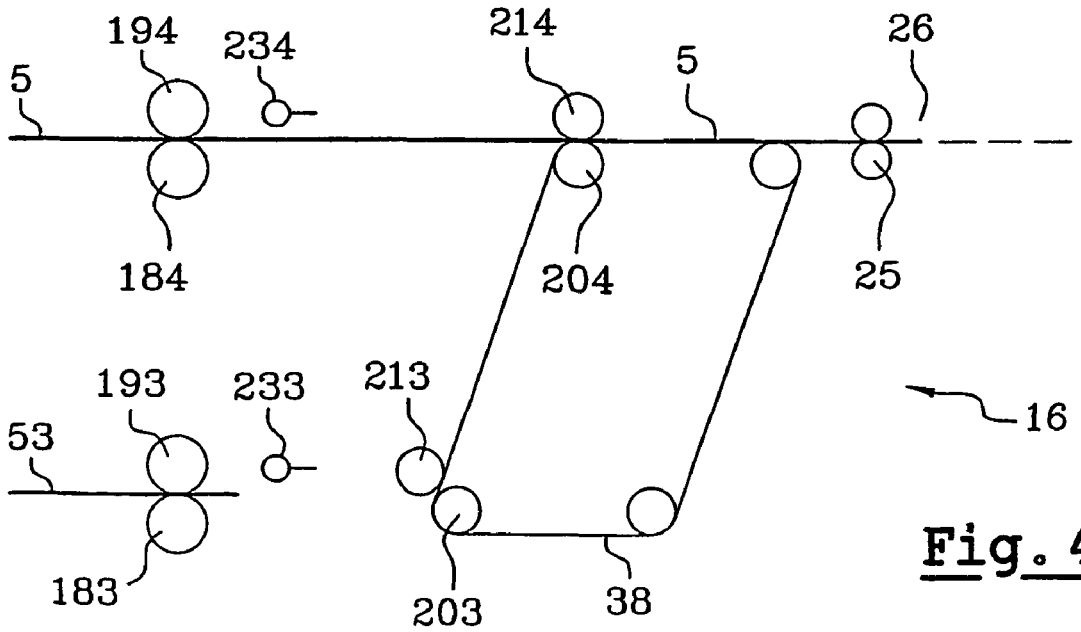

FIGS. 3 and 4 illustrate two variations of the device 16 in which the injection means are comprised of two devices in parallel and in which the holding of a film in stopped position is accomplished by means of the injection rollers for the film in question, and it is provided, at the outlet of the device 16, with means for directing the film being unwound toward the movable guide device 25, comprised for example of the set of bars that grip the film at its exit from the upstream set of pressure rollers 20, 21, and cause it to follow the appropriate path symbolized by the broken line 26, toward the packaging zone.

In FIG. 3, a first injection and cutting device includes injection rollers 181, 191, the pressure rollers 201, 211, and a cutting unit 231; a second injection and cutting device includes the injection rollers 182, 192, the pressure rollers 202, 212, and a cutting unit 232; the means for directing the film in process of unwinding toward the movable guide device 25 are two belts 36, 37 each of which is located at the outlet of an injection and cutting device to pick up the film exiting therefrom.

A first belt 36 is, for example, stretched between a pressure roller 201 of the first injection and cutting device and a tension roller 221; the second belt 37 is, for example, stretched between a pressure roller 212 of the second injection and cutting device and a tension roller 222.

In the illustrated example, the film 53 is driven into the first injection and cutting device; the film 5 is held immobilized by the injection rollers 182, 192 of the second injection and cutting device.

At the outlet of the first injection and cutting device, the film 53 is directed toward the means 25 by the belt 36.

In FIG. 4, a first injection and cutting device includes the injection rollers 183, 193, the pressure rollers 203, 213, and a cutting unit 233; a second injection and cutting device includes the injection rollers 184, 194, the pressure rollers 204, 214, and a cutting unit 234; the means for directing the film being unwound toward the movable guide device 25 are a single belt 38 the routing of which causes it to pass between the pressure rollers of the two injection and cutting devices.

Here, it is the film 53 that is held immobilized by the injection rollers 183, 193 of the first injection and cutting device, and the film 5 is guided toward the means 25 by the belt 38.

The invention claimed is:

1. A method of reloading a machine that packages products with a plastic film, said machine comprising injection and cutting means, which is fed with film from a first spool, and means for storing a second spool, the method comprising:

while the first spool is in the process of distribution, placing the second spool in the machine and keeping a free end of the film on the second spool ready at an entrance of the injection and cutting means;

detecting an approach of an end of the film from the first spool;

after having detected that the end of the film on the first spool has reached a predetermined position in the machine, stopping an advance of the film from the first spool into the injection and cutting means so as to leave a remaining part of the film from the first spool, wherein the remaining part of film from the first spool includes the end of the film from the first spool, and causing the free end of the film connected to the second spool to be drawn into said injection and cutting means, so that said second spool becomes a distributor, and such that the film from the first spool is not fastened to the film from the second spool; and while said second spool is in the process of distribution, replacing the first spool that was emptied with a new full spool and fusing a leading end of film from the new full spool to a trailing end of the remaining part of the film from the first spool and maintaining, at the entrance of the injection and cutting means, a free end of the remaining part of film connected to said new full spool, and utilizing film from the new full spool when the end of the film from the second spool, in the process of distribution, reaches a predetermined position in the machine.

2. The method according to claim 1, wherein the film from the first spool in the process of distribution is allowed to run out, and the predetermined position, which is detected, of the end of the first spool in the machine is determined when said end of the film from the first spool leaves the injection and cutting means.

3. The method according to claim 1, further comprising monitoring the passage of the end of the film from the first spool to a predetermined position situated between the first spool and the injection and cutting means; and when the passage into this position is detected, the advance of the film from the first spool into the injection and cutting means is stopped, in order for the remaining part of the film from the first spool to remain between said end of the film from the first spool and the injection and cutting means, and the free end of the film connected to the second spool is drawn into said injection and cutting means so that it becomes the distributing spool; and removing the empty first spool and putting the new full spool in place.

4. The method according to claim 3, wherein the detection of the predetermined position of the end of the film from the first spool in the process of distribution is performed twice:

a first time, when an approximate evaluation is made of the remaining length of film wound on the first spool during the distribution, then, when a predetermined value is reached, the advance of the film from the first spool into the injection and cutting means is stopped, the second spool is placed in service by causing the free end of the film from the second spool to be drawn into said injection and cutting means so that the second spool becomes the distributor and the film from the first spool is stopped; and a second time where the remaining length of film wound on the stopped first spool is determined, after which, at least one of:

a) if the length of film remaining on the stopped first spool is sufficient to continue packaging the products:

the advance of the film from the second spool into the injection and cutting means is stopped, the free end of the film connected to the first spool on standby is drawn into said means so that said first spool becomes the distributing spool again, and the passage is monitored of the upstream end of the film from the first spool into said predetermined position located between the first spool and the injection and cutting means; and when the passage into the predetermined position is reached, the advance of the film from the first spool into the injection and cutting means is stopped, and the second spool is placed in service again by causing the free end of the film connected to the second spool to be drawn into said injection and cutting means so that it becomes the distributing spool again;

the first spool is removed and the new full spool is installed; and the beginning of the film from the new full spool is fused to the end of the remaining part of the film from the removed first spool, and the operator waits until the remaining length of film wound on the second spool requires another change of spool; and b) if the remaining length of film on the stopped first spool is not enough to continue packaging the products:

packaging is continued with film from the second spool until it is determined that the remaining length of film wound thereon requires another change of spool, and during this time, the end of the film from the first spool is drawn into the machine, in said predetermined position located between the first spool and the injection and cutting means, and the empty first spool is removed and a new full spool is put in place; and the beginning of the film from the new full spool is fused to the end of the remaining film from the first spool that has just been removed; and the preceding operations are resumed by changing over from one spool to another.

5. The method according to claim 4, wherein at least one of the approximate evaluation of the length of film remaining wound on the first spool in the process of distribution, and the determination of the length remaining on the stopped first spool, and the monitoring of the passage of the last part of the end of the film from the first spool in the process of distribution, in the said predetermined position, are performed by the operator of the machine.

6. The method according to claim 4, wherein at least one of the approximate evaluation of the length of film remaining wound on the first spool in the process of distribution, and the determination of the length remaining on the stopped first spool, and the monitoring of the passage of the upstream end of the film from the first spool in the process of distribution, in the said predetermined position, are performed automatically.

7. The method according to claim 4, wherein at least one of the stopping of the first spool in the process of distribution, and the placing in service of the new full spool, and the return to service of the second spool are performed by the operator of the machine.

8. The method according to claim 4, wherein at least one of the stopping of the first spool in the process of distribution, and the placing in service of the new full spool, and the return to service of the second spool are performed automatically.

9. The method according to any of claim 3, wherein the machine has a compensation mechanism with roller compensators between the first spool and the injection and cutting means, and between the second spool and the injection and cutting means, and the predetermined position is located between the first spool and the injection and cutting means, and an additional predetermined position is located between the second spool and the injection and cutting means, wherein the predetermined positions are monitored so that the advance from the first or second spool in the process of distribution is stopped when the end of the film carried by the first or second spool, respectively, is between the first or second spool and the corresponding compensation mechanism.

* * * * *